United States Patent [19]

Kohl et al.

[11] Patent Number: 4,785,218

[45] Date of Patent: Nov. 15, 1988

[54] TUNGSTEN HALOGEN LAMP BASE

[75] Inventors: Clyde B. Kohl, Winchester, Ky.; John F. Ellis, El Paso, Tex.; Clair D. Stewart, Winchester, Ky.

[73] Assignee: GTE Products Corporation, Danvers, Mass.

[21] Appl. No.: 72,952

[22] Filed: Jul. 13, 1987

[51] Int. Cl.[4] ..... H01K 1/28; H01K 1/46

[52] U.S. Cl. ..... 313/579; 313/318

[58] Field of Search ..... 313/318, 579; 439/616, 439/354, 356

[56] References Cited

U.S. PATENT DOCUMENTS 1,760,693 5/1930 Gustin ..... 439/356 X
3,496,403 2/1970 Palmermo et al. ..... 313/579
3,997,808 12/1976 Wojtowicz ..... 313/318 X
4,553,066 11/1985 Fields et al. ..... 313/579 X

OTHER PUBLICATIONS

"Designers Handbook Light Source Applications", Sylvania (GTE), 1980, pp. 17 & 18.

*Primary Examiner*—Palmer C. DeMeo
*Attorney, Agent, or Firm*—Lawrence R. Fraley

[57] ABSTRACT

A prefocused tungsten-halogen lamp including a vitreous envelope having a press-seal at one end thereof for receiving and supporting lead-in wires that in turn support a filament disposed in the envelope. The press-seal is received in an all ceramic base with a close fit with the sidewalls of the base, while leaving a void space under the press-seal that is filled with a sealing cement preferably injected into the void space through a hole in the ceramic base.

13 Claims, 2 Drawing Sheets

TUNGSTEN HALOGEN LAMP BASE

TECHNICAL FIELD

The present invention relates in general to tungsten halogen lamp bases in which the lamp capsule includes a press-sealed end. The present invention relates, not only to an improved lamp base construction, but also to an improved method of manufacture of the tungsten halogen lamp and to an improved lamp and lampholder combination. The present invention is, in particular, employed in connection with what are commonly referred to in the art as medium two-pin lamps.

BACKGROUND

Existing tungsten halogen lamps, such as the common, medium two-pin lamp, are typically comprised of a lamp capsule including a sealed envelope of a vitreous material having a bulb portion and a press-seal at one end thereof, and a base secured to the envelope for supporting the press-seal thereof. One presently-employed base is comprised of a metal shell fitted with a ceramic insulator at the bottom thereof. The ceramic insulator in turn supports two connector pins. This type of base with a metal shell is used for a number of lamp types ranging in wattage from 500 to 1000 watts, and voltages as high as 240 volts. Lamps of this type have widespread use in studio, theatre, and television lighting applications.

Several problems have been encountered with these metal/ceramic lamp bases. It is difficult to align the capsule and base on the same center line. Additionally, there exists a potential for short-circuiting the metallic base shell to the wire/fuse electrical wiring between the envelope and pins. With the metal shell there is also a possible breakdown of the shell at higher temperatures and voltages. Lastly, the appearance of the product may appear unsightly to a prospective customer.

Tungsten halogen lamps are also known in which the base is constructed of a ceramic material. In this regard, see U.S. Pat. Nos. 3,974,370, 4,243,907 and 4,568,854. However, in all of these ceramic base constructions, the base is formed so that it will accommodate a sealing cement between the base and the press-seal (such that the cement almost totally surrounds the press-seal). These ceramic base lamps, although having solved the aforementioned short-circuiting and breakdown problems are still characterized by difficulty of alignment between the capsule and the base.

Accordingly, it is believed that a lamp base which overcomes the aforementioned disadvantages of existing bases would constitute an advancement in the art.

DISCLOSURE OF THE INVENTION

One object of the present invention, therefore, is to provide an improved tungsten halogen lamp and in particular one having an improved, all-ceramic lamp base.

Another object of the present invention is to provide an improved tungsten halogen lamp base along with an associated method of manufacture, as well as a combination lamp and lampholder.

A further object of the present invention is to provide an improved tungsten halogen lamp employing a ceramic lamp base and which provides for positive alignment of the lamp envelope and base.

Still another object of the present invention is to provide an improved tungsten halogen lamp employing a ceramic base that eliminates the possibility of lead-fuse short circuiting and furthermore eliminates damage to the lamp due to high temperature and/or voltage operation.

Still a further object of the present invention is to provide an improved tungsten halogen lamp that is of improved appearance and that is characterized by ease of alignment between the lamp capsule and base during the manufacture thereof.

In accordance with one aspect of the invention there is provided an improved tungsten halogen lamp, which is in particular characterized by an improved base construction that provides for accurate alignment between the lamp envelope and base and in which the lamp is furthermore characterized by cooler press-seal operating temperatures in comparison to prior lamp constructions. A lamp constructed in accordance with the present invention comprises a sealed envelope of a vitreous material having a bulb portion and a press-seal at one end thereof. A pair of electrically conductive lead-in wires are hermetically sealed through the press-seal in spaced-apart relationship to one another and extend beyond the press-seal. A filament is disposed in the bulb portion of the envelope and is connected across the inner ends of the lead-in wires. A ceramic base supports the press-seal of the envelope and includes integral sidewall means and base wall means. The sidewall means define an envelope accommodating cavity dimensioned to snugly receive the envelope's press-seal therein. The press-seal is positioned in the ceramic base with a void space under the press-seal and between the press-seal and base wall means. A sealing cement is disposed in this void space. The snugness of fit of the envelope in the ceramic base provides direct thermal conductivity therebetween and further prevents any substantial sealing cement from residing therebetween. For injection of the sealing cement, there is provided a passage in the ceramic base communicating with the void space.

In accordance with the invention, there is also provided an improved lamp and lampholder in which the lampholder has a socket dimensioned to receive the ceramic base with a close tolerance fit. The socket has metallic sidewalls for close fit receipt of the ceramic base. The ceramic base and lampholder socket preferably have complementary interlocking means that may be comprised of an indent in the ceramic base and a clamp means in the lampholder socket.

Also, in accordance with the invention, there is provided an improved method of making a prefocused tungsten halogen lamp in which the lamp is comprised of a sealed envelope having a bulb portion and a press-seal supporting thereat a pair of electrically conductive lead-in wires that in turn support a filament disposed in the bulb portion of the sealed envelope. In accordance with the steps of this method, there is provided a ceramic base for supporting the press-seal of the envelope and including integral sidewall means and base wall means with the sidewall means defining an envelope accommodating cavity. A next step of the method involves inserting the sealed envelope into the base cavity but providing a void space under the press-seal between the press-seal and the base wall means. Next is the step of injecting a sealing cement into the void space to fill the void space without any substantial sealing cement extending up the sides of the base.

BEST MODE FOR CARRYING OUT THE INVENTION

For a better understanding of the present invention together with other and further objects, advantages and capability thereof, reference is made to the following disclosure and appended claims in connection with the above described drawings.

The present invention relates to an improved lamp construction and in particular an improvement in tungsten halogen lamps, particularly, the base construction thereof. The lamp includes an all ceramic electrically insulated base that is described herein in FIGS. 1–3 for application to what is referred to in the art as a medium two-pin lamp. Also described herein in FIGS. 4–7 are steps of assembly in the manufacture of the lamp also in accordance with the present invention.

Figure 1:
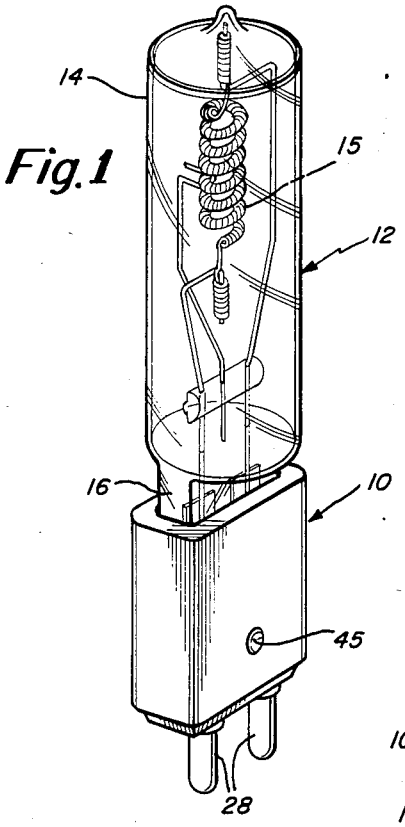
FIG. 1 is a perspective view of a tungsten halogen lamp constructed in accordance with the principles of the present invention.

FIG. 1 is a perspective view illustrating the lamp of the present invention which is in the form of a medium two-pin, tungsten halogen lamp having an all ceramic base 10 for supporting the lamp capsule 12. The lamp capsule 12 has a bulb portion 14 (typically cylindrically shaped) and a press-sealed end portion 16 (rectangularly shaped in cross-section). The press-sealed end portion 16 is oriented at the bottom of (below) the capsule when the lamp is in its usual operating position as illustrated in FIG. 1. FIG. 1 also illustrates a filament 15 (i.e., of coiled-coil tungsten material) which is supported in a conventional manner within the bulb portion 14.

Figure 2:
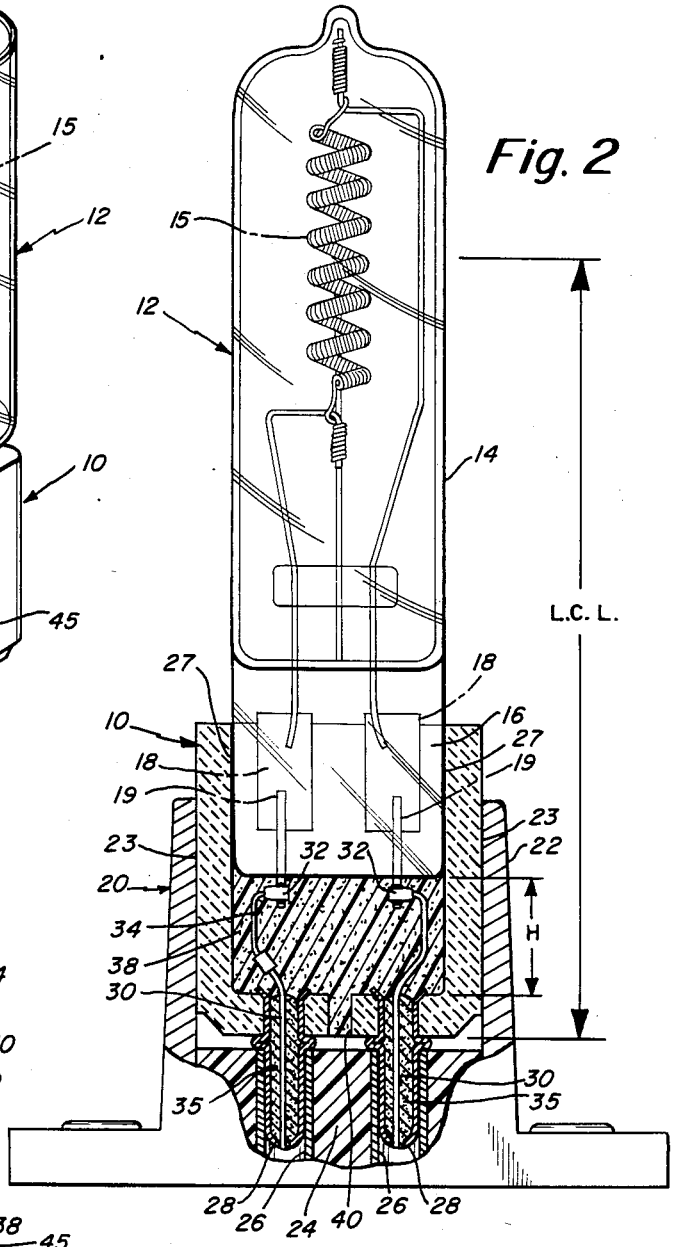
FIG. 2 is an enlarged, side elevation view of the lamp of FIG. 1 cut away at the base and furthermore illustrating the lamp inserted into a lampholder.
Figure 3:
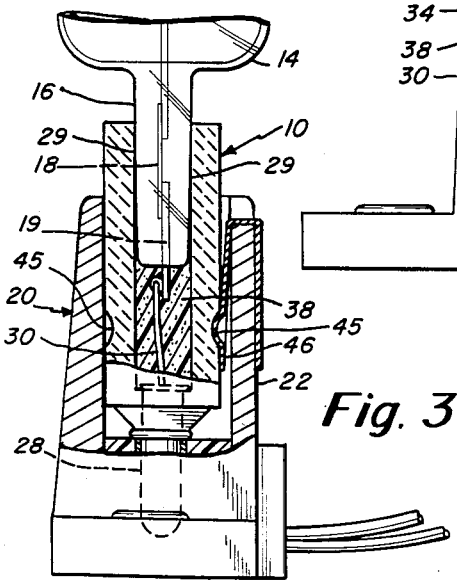
FIG. 3 is a fragmentary cross-sectional view taken in a direction transverse to the cross-sectional view of FIG. 2.

FIGS. 2 and 3 illustrate the lamp of FIG. 1 disposed and retained within a lampholder 20. The lampholder may be of currently known and available types "TP-4" or "TP-22", both of which are available from the assignee of the present invention. The lampholder 20 has upright metallic sidewalls 22 defining a socket for receiving the ceramic base 10 of the lamp with a close tolerance fit, particularly as noted in FIG. 2 along the joining edge 23. The close tolerance fit aids in achieving the prefocusing feature of the ceramic base. The lampholder 20 also includes an insulating base 24 for supporting two pin sockets 26 adapted to receive, as illustrated in FIG. 2, respective pins 28 which extend from the base 10 of the lamp.

In accordance with the present invention, the press-sealed end 16 of the capsule 12 is adapted to fit within the ceramic base 10 with a very close tolerance fit. This is illustrated in FIG. 2 by the close fit at interface 27 on one side and by the further close fit at interface 29 on the other side. This close tolerance fit between the capsule and base assures that the center lines of these components are superimposed, thus producing a lamp with proper (precise) alignment. The closeness of the fit of the capsule's press and the base as well as between the ceramic base and the lampholder provide a positive alignment of the filament on the lamp center line. Thus the term "prefocus".

With further reference to FIGS. 2 and 3, it is noted that the filament 15 couples by way of support wire leads to thin, conductive metallic (molybdenum) foil strips 18, which elements in turn form part of the lead-in wires of the invention. At the bottom end of these strips 18 are provided the leads 19. A pair of outer lead wires 30 are welded to the respective stub leads 19. For this purpose, at the upper end of each of the outer lead wires there is provided a sleeve 32 that is crimped to the end of the wires. Each sleeve 32 is in turn directly welded to the respective stub lead 19. It is to be understood that for purposes of definition, by the term lead-in wire as used herein is meant to include the conductive wire(s) which provide the requisite circuit path from the exterior of the lamp envelope's press seal through to filament 15. In simplest form, this could constitute a singular wire. Preferably, however, this includes the filament's internal support wires, the sealed foil conductors, the stub leads and the smaller diameter outer lead wires (30). In one of these (to the left in FIG. 2), it also includes the below mentioned fuse.

It is noted that one of the outer lead wires 30 is provided with a fuse 34 which in turn forms a part of the conductive path of the respective lead-in wire. As illustrated in FIG. 2, both of these outer leads 30 have essentially a 90° bend at the top end thereof and then extend downwardly. It is noted that the outer lead wires 30 are of smaller diameter than the stub leads 19, this being for convenience of manufacturing. The heavier leads are used for the press-seal area with the outer lead wires 30 (that are welded to the stub leads) being matched for the desired wattage for the lamp. At the lower end, the outer lead wires extend inside of the pins 28 and are secured therein by means of solder 35 (as illustrated in FIG. 2). In further connection with the method of manufacture of the lamp of this invention, reference is directed to FIGS. 4–7 to be described hereinafter.

As indicated previously, the ceramic base 10 is dimensioned to receive the press-seal of the capsule with a close tolerance fit. There is thus substantially little or no room between these members. As stated, this close fit provides the prefocusing feature for improved alignment. However, in accordance with the invention, there is provided a relatively substantial sized void space 36 (see FIG. 5) under the press-seal and into which is injected a sealing cement 38. For the purpose of injecting the sealing cement, the ceramic base 10 is provided at the bottom thereof with an aperture 40. This aperture 40 is preferably disposed between the pins 28. The sealing cement that is employed may be commercially available Saurereisen No. 8 cement. The cement that is injected fills the void space 36 (FIGS. 5 and 6) but, significantly, does not extend up along the sides of the press-seal to any substantial extent. As illustrated in FIG. 2, the height of the void space, illustrated by the dimension H in FIG. 2 may be on the order of about 0.15—0.20 inch. The overall height of base 10 in this example is only about 1.00 inch. Thus, void space 36 occupies a total height of about 20 percent of the overall base height or about 25 percent of the overall height of the internal opening of base 30 (given a base wall thickness of about 0.15 inch). In this same example, the base sidewalls possess a thickness of about 0.10 inch. The depth of the opening in the ceramic base allows the press to be larger and the molybdenum foil to be placed farther away from the filament. Temperature decreases at a rate equal to the fourth power of the distance from the heat source. Thus, the ceramic base allows leads (conductive) to fit to the inner edge of the side wall without shorting to the metal wall as in the "metal can" base design. This reduces the space needed between the lead wires coming from the press and the top of the base pins. The looping provides the length of fuse lead needed for adequate fuse action.

Figure 4:
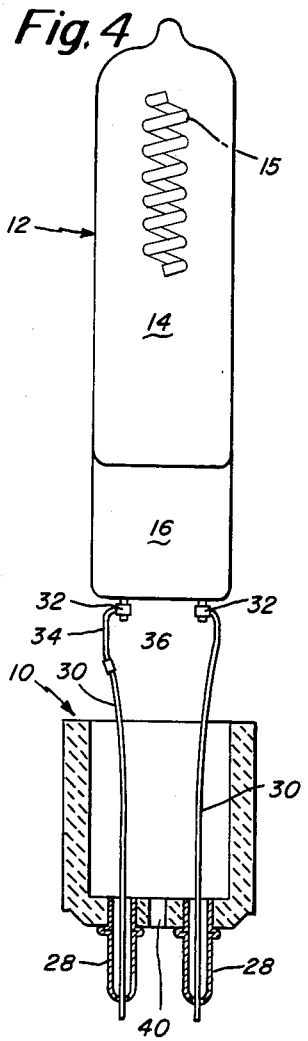
FIGS. 4–7 illustrate separate successive steps in accordance with the method of manufacture of the lamp of the present invention.

Reference is now made to FIGS. 4–7 for an illustration of certain sequences in accordance with the present invention in connection with the method of manufacture of the lamp. FIG. 4 shows the capsule 12 positioned above the ceramic base 10. The pair of electrically conductive outer lead wires 30 have been secured to the stub leads that extend downwardly from the press-seal end 16 of the capsule. The outer lead wires are secured (i.e., by welding) at the sleeves 32. It is noted that the bottom end of each lead-in wire 30 is made sufficiently long so as to be easily accommodated in the pins 28 by extending downwardly into the pins and out the bottom thereof (through bottom end apertures in each pin). At this stage of manufacture, it is noted that the base 10 (void 36) is unfilled and furthermore that pins 28 are at this time unsoldered. Thus, the outer lead wires are free to easily move though the pins 28, greatly facilitating this assembly operation.

Figure 5:
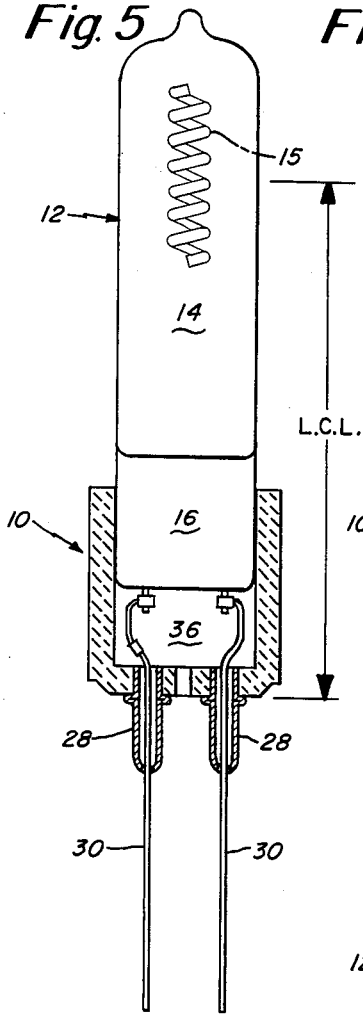

FIG. 5 shows the next step in which the press-seal end 16 of the capsule is aligned and fitted within the ceramic base 10, thus forming a prefocused unit. As indicated previously, this fit is a close tolerance fit. The capsule is disposed in the base 10 at the location illustrated in FIG. 5. The outer lead wires 30 continue to extend down through the pins 28. Once the capsule is in the proper position, the excessive lengths of these wires are removed (i.e., cut off). The depth with which the capsule is inserted into the base 10 is to a position in which the filament 15 is at the proper and accurate light-center-length (LCL) as illustrated in FIGS. 2 and 5. This length, as shown, is from the filament center to the bottom surface (outer) of the positioned base.

Figure 6:
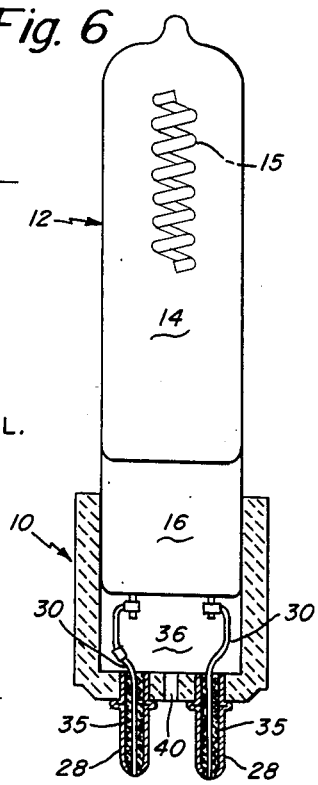

FIG. 6 illustrates the outer lead wires 30 having been cut and furthermore illustrates the wires and pins having been soldered.

Figure 7:
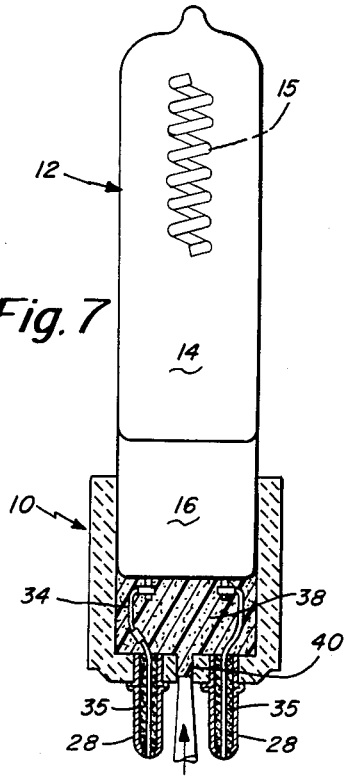

Reference is now made to FIG. 7 showing the final step in the manufacture of the lamp. This step illustrates the injection of a sealing cement through the aperture 40 in base 10 so as to fill the void space 36. As illustrated in FIG. 7, this space is substantially totally filled with a sealing cement 38, but substantially none of this passes up along the outer walls of the envelope's press seal.

With the improved lamp base construction in accordance with the invention and with the further improvement in the combination of lamp and lampholder, there has been realized enhanced lamp operation. In particular, desirably lower press-seal temperatures have been surprisingly observed compared to the aforementioned, previous "metal can" versions of lamp bases. This lower press-seal temperature is possible with a longer press having the molybdenum foil further from the filament, allowing the temperature to be lower at the weld to the outer lead.

Temperatures decrease by the fourth power of the distance from the heat source (filament). The temperature vs. life relationship in a tungsten halogen lamp is basically a matter of preventing oxidation of the outer lead to molybdenum foil weld. Deterioration (oxidation) of this weld area occurs more rapidly when temperatures are increased. Thus, a lower temperature allows the filament, lamp pressure, halogen atmosphere and applied voltage to determine how long the lamp will function. The tight fit of the lamp into the lamp holder is furthermore facilitated by means of the interlocking means illustrated primarily in FIG. 3 of the present application This includes an indentation 45 (See FIG. 1) in one of the sidewalls of the ceramic base 10, in combination with a clamp means as illustrated by the securing clip 46 illustrated in FIG. 3. The clip 46 urges the lamp base into intimate contact with the metal sidewalls of the lampholder. FIG. 2 also shows the relatively tight fit at the sides between the ceramic base and the metal sidewalls of the lampholder. The sidewalls defining the socket are preferably of aluminum.

Lamps produced in accordance with the teachings of the invention showed that the all-ceramic base design as taught herein operate longer than lamps of the aforementioned "metal can" type. Analyses of the outer lead molybdenum foil connection at the lamp's press area showed less deterioration in comparison to earlier, known versions. Additionally, these new, all-ceramic base designs eliminated the aforementioned lead wire - outer "can" shorting inherently available in "metal can" type assemblies thus adding significantly to product quality. Additional significant advantages have been defined in detail above.

While there have been shown and described what are at present considered the preferred embodiments of the invention, it will be obvious to those skilled in the art that various changes and modifications may be made therein without departing from the scope of the invention as defined by the appended claims.

We claim:

1. A lamp comprising:

a sealed envelope of vitreous material having a bulb portion and a press-seal at one end thereof;

a pair of electrically conductive lead-in wires hermetically sealed through said press-seal in spaced-apart relationship to one another and extending externally of said envelope beyond said press-seal;

a filament disposed in said bulb portion and electrically coupled to said lead-in wires;

a ceramic base for supporting said press-seal of said envelope and including integral sidewall means and base wall means, said sidewall means defining an envelope accommodating cavity dimensioned to snugly receive at least a portion of said envelope press-seal therein, said envelope press-seal being snugly positioned in said ceramic base with a void space between said press-seal and said base wall means;

a sealing cement disposed within said void space to secure said lamp in said base, wherein said press-seal portion enveloped by said base sidewall means is substantially free of sealing cement; and a sealing cement passage in said ceramic base communicating with said void space and through which the sealing cement is injected into said void space.

2. THe lamp as set forth in claim 1 including a pair of base pins extending from said ceramic base, said base wall means of said ceramic base having spaced holes for receiving said base pins.

3. The lamp as set forth in claim 2 wherein said lead-in wires connect, respectively, to said base pins.

4. The lamp as set forth in claim 1 wherein the snugness of fit of the envelope in said ceramic base provides direct thermal conductivity therebetween and further prevents any substantial sealing cement to reside therebetween.

5. The lamp as set forth in claim 1 in combination with a lampholder having a socket dimensioned to receive said ceramic base with a close tolerance fit.

6. The lamp as set forth in claim 5 wherein said socket has metallic sidewalls for close fit receipt of said ceramic base.

7. The lamp as set forth in claim 6 wherein said ceramic base and lampholder socket have complementary interlocking means.

8. The lamp as set forth in claim 7 wherein said interlocking means includes an indent in said ceramic base, and a clamp means in said lampholder socket.

9. The lamp as set forth in claim 1 wherein said void space occupies a height in the area of 25% of the height of said sidewall means.

10. In combination, a pre-focused lamp and a lamp holder, said lamp comprising, a sealed envelope of vitreous material having a bulb portion and a press-seal at one end thereof, a pair of electrically conductive lead-in wires hermetically sealed through said press-seal and supporting a filament disposed in said bulb portion connected across the inner ends of said lead-in wires, a ceramic base for supporting said pressseal of said envelope and including integral sidewall and base wall means defining an envelope accommodating cavity dimensioned to snugly receive at least a portion of said envelope press-seal therein with said press-seal being positioned in said ceramic base with a void space under the press-seal filled with a sealing cement, wherein said press-seal portion enveloped by said base and sidewall means is substantially free of sealing cement, and a sealing cement passage in said ceramic base communicating with said void space and through which the sealing cement is injected into said void space, said lampholder having a socket dimensioned to receive said ceramic base with a close tolerance fit.

11. The combination as set forth in claim 10 wherein said socket has metallic sidewalls for close fit receipt of said ceramic base.

12. The combination as set forth in claim 11 wherein said ceramic base and lampholder socket have complementary interlocking means.

13. The combination as set forth in claim 12 wherein said interlocking means includes an indent in said ceramic base, and a clamp means in said lampholder socket.

* * * * *